US005312278A

United States Patent [19]

Jen

[11] Patent Number: 5,312,278

[45] Date of Patent: May 17, 1994

[54] SWIMMING GLOVE

[76] Inventor: Wu R. Jen, No. 32, Alley 118, Lane 174, Sec. 2, Ta Kuan Road, Pan Chiao Taipei, Taiwan

[21] Appl. No.: 120,786

[22] Filed: Sep. 15, 1993

Related U.S. Application Data

[63] Continuation-in-part of Ser. No. 950,287, Sep. 24, 1992, abandoned.

[51] Int. Cl.[5] ..... A63B 31/10

[52] U.S. Cl. ..... 441/57

[58] Field of Search ..... 441/55, 56, 57, 58, 441/59, 64

[56] References Cited

U.S. PATENT DOCUMENTS

| | | | |
|---|---|---|---|
| 1,275,005 | 8/1918 | Eckman | 441/57 |
| 1,588,635 | 6/1926 | Webb | 441/57 |
| 2,010,750 | 8/1935 | Dawzda | 441/57 |
| 2,028,461 | 1/1936 | Lindsey | 441/57 |
| 2,423,571 | 7/1947 | Wilen | 441/64 |
| 2,889,563 | 6/1959 | Lamb et al. | 441/64 |
| 3,019,458 | 2/1962 | Barbieri et al. | 441/64 |
| 3,107,371 | 10/1963 | Thompson | 441/59 |
| 3,290,707 | 12/1966 | Montgomery | 441/59 |
| 3,480,978 | 12/1969 | Farmer | 441/64 |
| 4,027,347 | 6/1977 | Sato | 441/57 |
| 4,521,011 | 6/1985 | Solloway | 441/59 |

FOREIGN PATENT DOCUMENTS

| | | | |
|---|---|---|---|
| 23034 | 2/1906 | Austria | 441/57 |
| 262120 | 5/1968 | Austria | 441/59 |
| 2525932 | 12/1976 | Fed. Rep. of Germany | 441/58 |

*Primary Examiner*—Michael S. Huppert
*Assistant Examiner*—Thomas J. Brahan
*Attorney, Agent, or Firm*—Shoemaker and Mattare Ltd

[57] ABSTRACT

A swimming glove includes a glove body and finger sheaths, and a sleeve made from a woven fabric having webs joining the finger sheaths and a blade bilaterally extending outward from the sleeve thereof and the sheaths for the thumb and the little finger for increasing the force of the stroke of the hand. The blade has a first area adjacent to glove body, whose first part is thinner than a second part adjacent to the sleeve, for maximum finger dexterity and comfort. Hinges are formed on the blade along the sleeve so that the blade is turned toward the rowing direction of the hand to reduce water resistance upon each return stroke of the hand.

1 Claim, 6 Drawing Sheets

SWIMMING GLOVE

This application is a continuation-in-part application of U.S. patent application Ser. No. 07/950,287 filed on Sep. 24, 1992, which is now abandoned.

BACKGROUND OF THE INVENTION

The present invention relates to a swimming glove and relates more particularly to a glove having webs between fingers for use in swimming and some other aquatic sports.

In swimming or some other aquatic sports, flippers and swimming gloves may be used to increase the force of the kick or hand stroke. Regular swimming gloves are commonly made from rubber having webs joining the sheaths for the fingers. One common disadvantage of these skin diving gloves is that they can not eliminate the tightness over the knuckles when hand closes. Another disadvantage of these skin diving gloves is a relatively high cost of manufacturing.

SUMMARY OF THE INVENTION

The present invention eliminates the aforesaid disadvantages. It is an object of the present invention to provide a swimming glove which is designed for maximum finger dexterity and comfort. It is another object of the present invention to provide a swimming glove which greatly increases the force of the stroke of the hand. To achieve the aforesaid objects, there is provided a swimming glove made from a flexible material for maximum finger dexterity and comfort, having a glove body, finger sheaths extending from one end of the glove body, and a sleeve extending from another end of the glove body, webs joining the finger sheaths, and a blade bilaterally extending outward from the sleeve and the sheaths for the thumb and the little finger for increasing the force of the stroke of the hand. The blade is curved inward toward the rowing direction of the hand and has grooves on the back along the sleeve to produce the function of hinges permitting the blade to be turned toward the rowing direction of the hand to reduce water resistance upon each return stroke of the hand.

BRIEF DESCRIPTION OF THE PREFERRED EMBODIMENT

Figure 1:
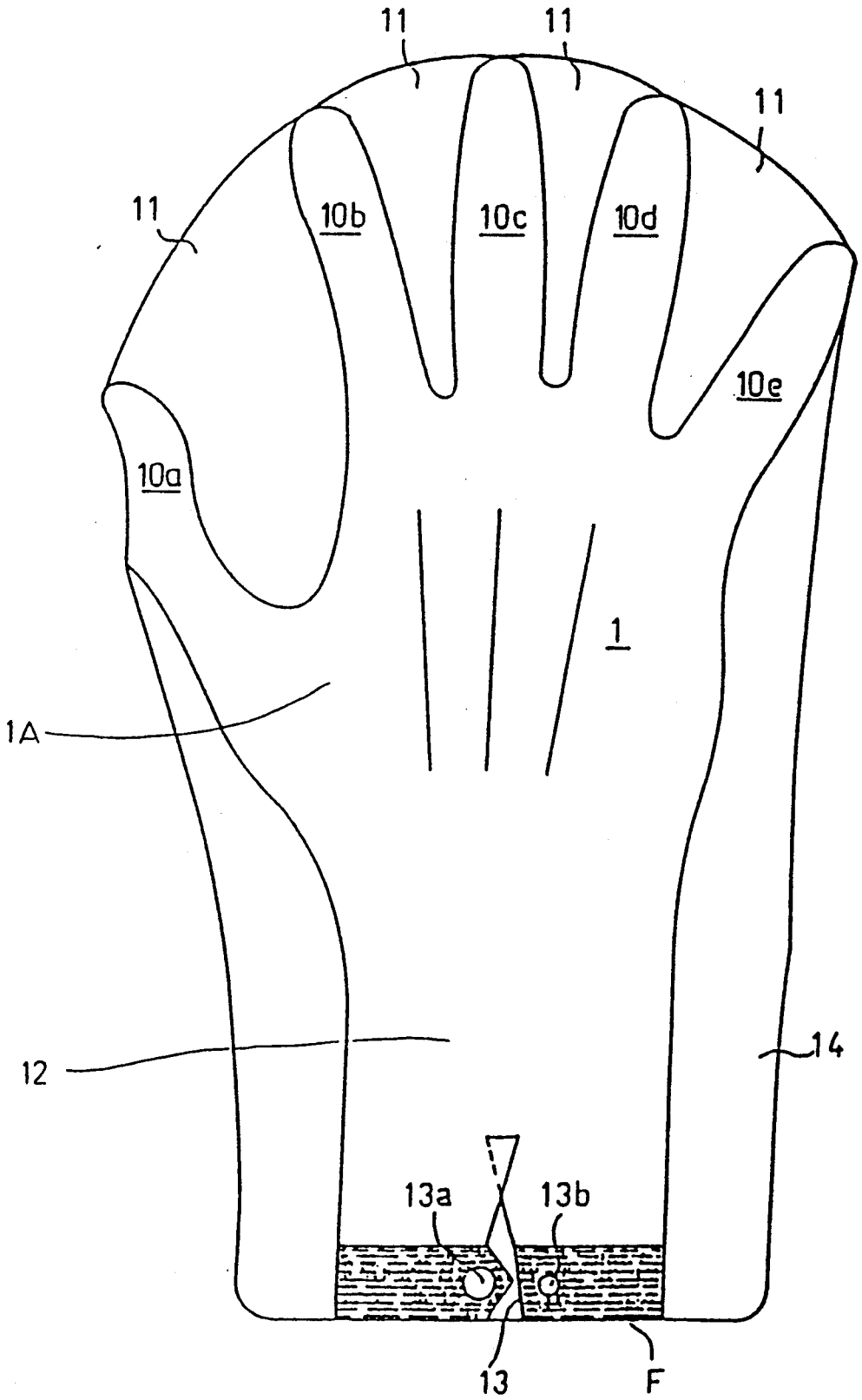
FIG. 1 is a back plan view of a swimming glove embodying the present invention.

Referring to FIG. 1, swimming glove 1 has a glove body 1A adapted to fit on a hand of the wearer of the swimming glove 1, finger sheaths 10*a*, 10*b*, 10*c*, 10*d* and 10*e* extending from one end to respectively fit the thumb, forefinger, middle finger, ring finger and little finger of the wearer, and a sleeve 12 extending from an opposite end of glove body 1 to fit the wrist and the forearm of the wearer. Glove body 1A, finger sheaths 10*a*, 10*b*, 10*c*, 10*d* and 10*e*, and sleeve 12 are made into one piece with a flexible material such as a regular cloth, or a woven fabric, to provide good flexibility for maximum finger and hand dexterity and comfort. Webs 11, which join each neighboring two finger sheaths, are also made with the same material for glove body 1A. Sleeve 12, which is also made of the same woven fabric or cloth, may be variously embodied in length; however, at least a length corresponding to the front half part of the wearer's forehand is preferable. Sleeve 12 has a free end provided with a cut 13 and a pair of fasteners 13*a*, 13*b* to facilitate the wearing and the removal of the swimming glove 1. A Velcro type fastener F may be provided at the edge of the free end of sleeve 12.

Figures 2, 2A:
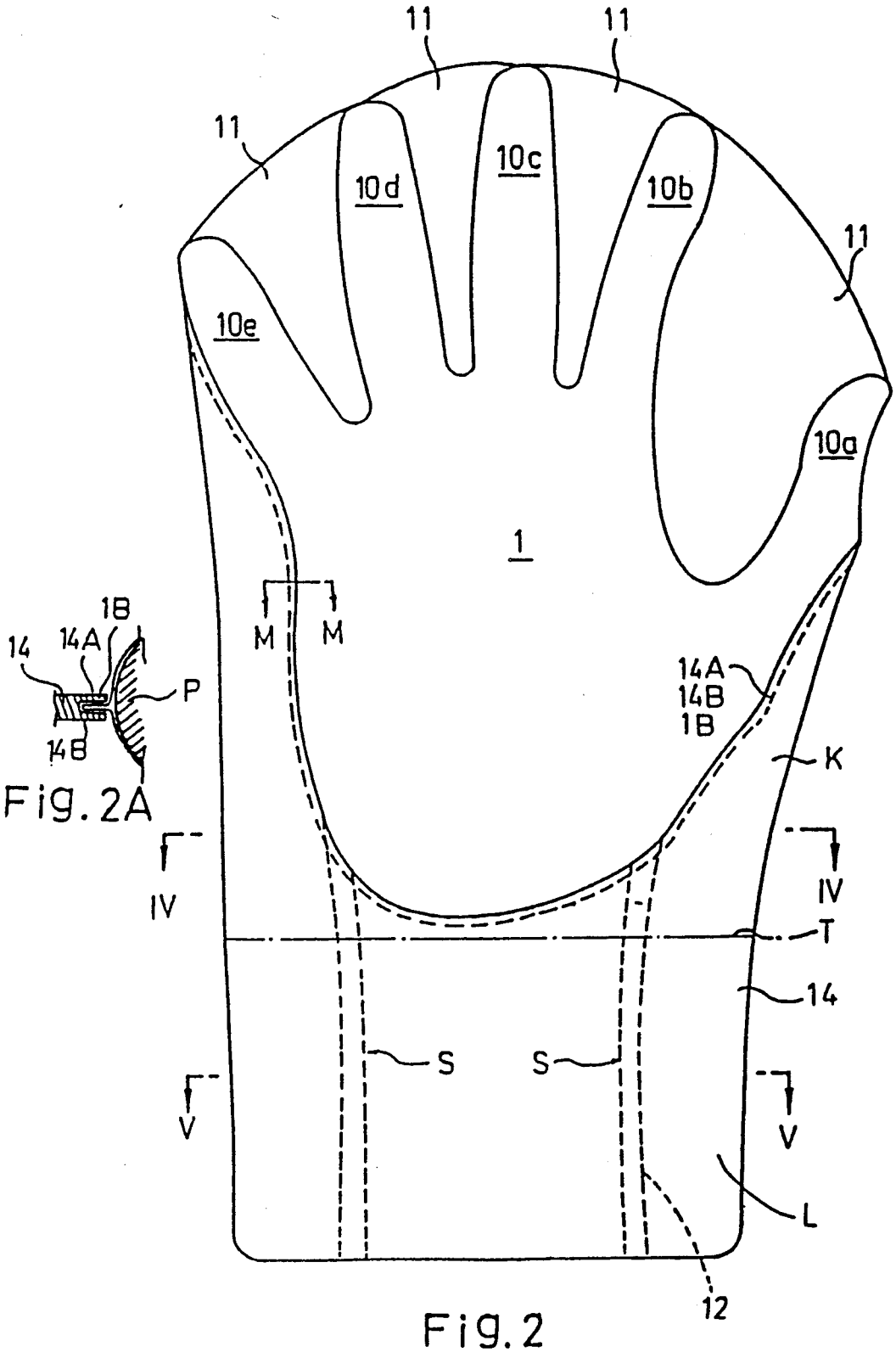
FIG. 2 is a front plan view of the swimming glove of FIG. 1.
FIG. 2A is a sectional view taken on line M—M of FIG. 2 on an enlarged scale.
Figure 3:
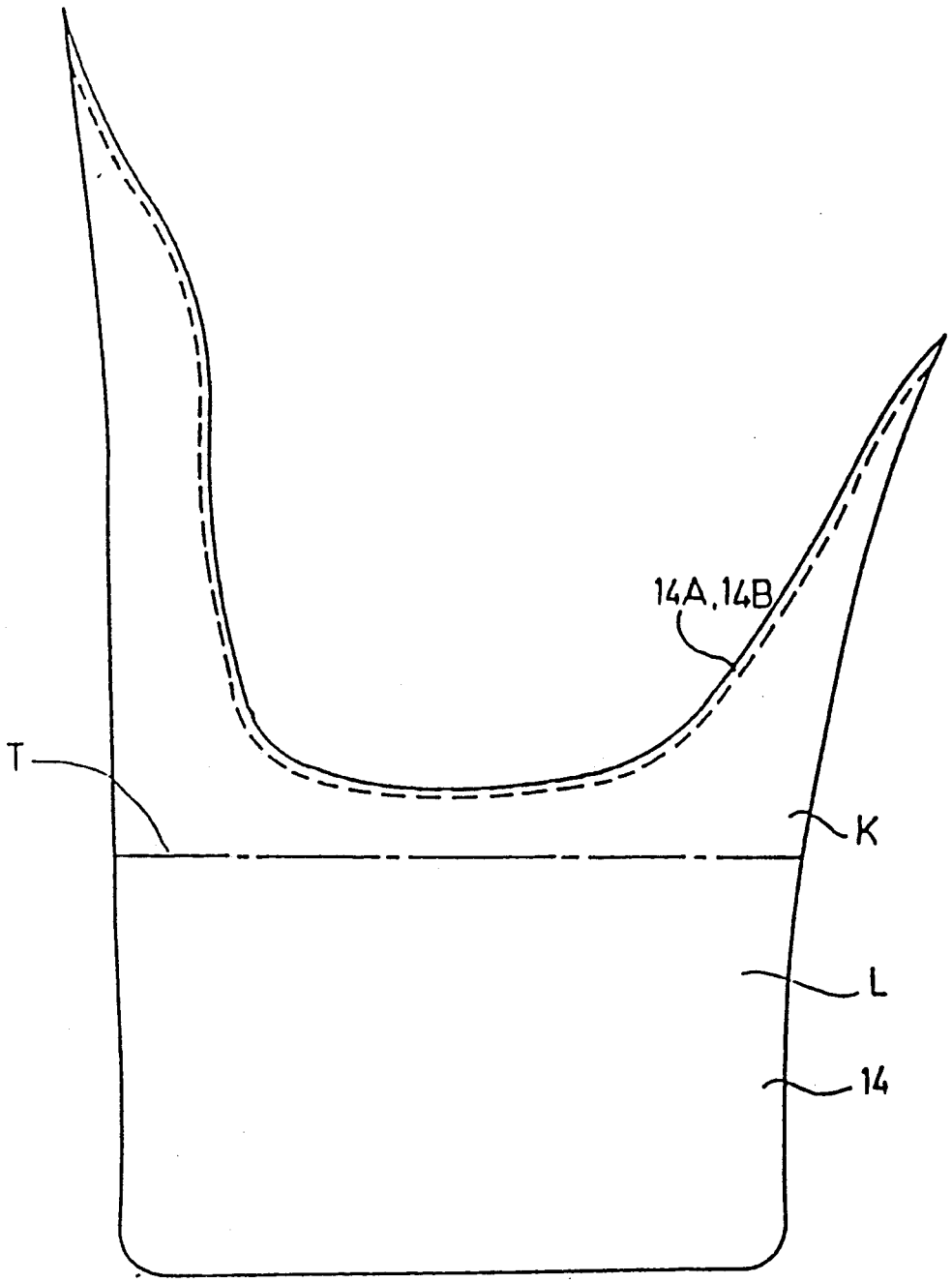
FIG. 3 is a plan view of the blade.
Figure 4:
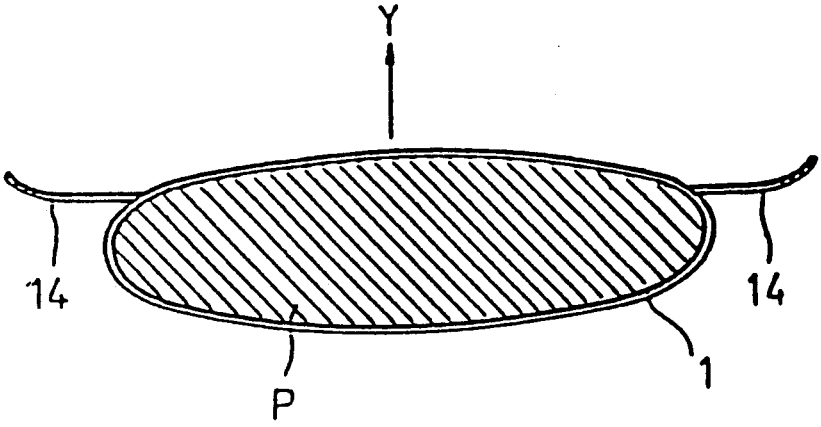
FIG. 4 is a sectional view taken on line IV—IV of FIG. 2.
Figure 5:
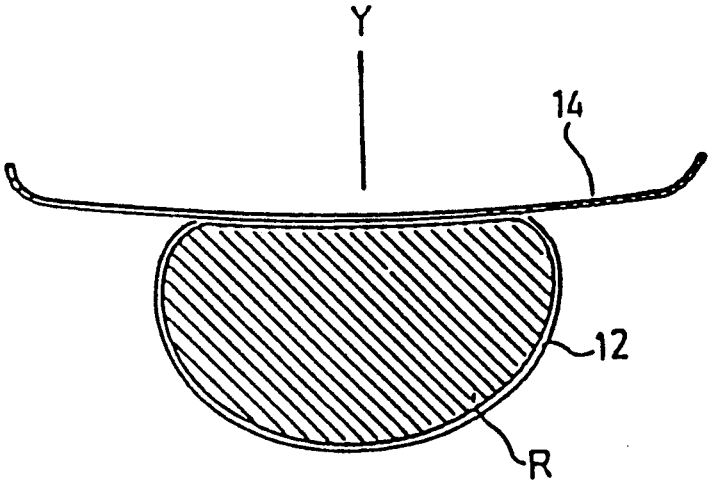
FIG. 5 is a sectional view taken on line V—V of FIG. 2.

Referring to FIGS. 2, 3, 4 and 5, blade 14 is formed on swimming glove 1 bilaterally extending outward from sleeve 12, the bottom border of the glove body 1A, the outside border of the thumb's sheath 10*a* and the little finger's sheath 10*e*. Blade 14 may be made from a plastic, rubber or any suitable material; however, a less flexible material in comparison with the material for glove body 1A is preferable. Blade 14 is prepared as an independent member as shown in FIG. 3, and then fixedly joined with sheath 10*a* for thumb, sheath 10*e* for little finger, glove body 1A and sleeve 12. The upper area of blade 14 adjacent to the thumb's sheath 10*a* and the bottom border of the glove body 1A and the little finger's sheath 10*e*, namely the K (first area) above the imaginary line T in FIG. 2 is relatively thinner so as to provide a necessary flexibility to facilitate the movement of the hand wearing swimming glove 1, while the lower area of blade 14 corresponding to the area L below the imaginary line T of FIG. 2 is made relatively thicker to provide a necessary stiffness in comparison with the above described upper area K of blade 14. Blade 14 is fixedly joined with sleeve 12 and the thumb's sheath 10*a* and the little finger's sheath 10*e* by stitches (dotted lines S in FIG. 2) or through an adhesive material. As illustrated in FIG. 2A and FIG. 3, blade 14 has a pair of parallel projecting strips 14A, 14B along its connecting edge to glove body 1A and the thumb's sheath 10*a*/little finger's sheath 10*e*. Glove body 1A is provided with an edge 1B extending along the outer sides of thumb sheath 10*a* and little finger sheath 10*e*, two sides of glove body 1A, and the bottom side of glove body 1A, as shown in FIGS. 2 and 2A. By inserting edge 1B of sleeve 12 and the thumb or little finger's sheath 10*a* or 10B in between the pair of projecting strips 14A, upper area K of blade 14 is connected to glove body 1A, thumb sheath 10*a* and little finger sheath 10*e*, with lower area L abutting a forward side (which is the same side as the palm of the hand) of sleeve 12. Blade 14 is fastened in place by stitches or through an adhesive material; stitches or adhesive is applied to strips 14A and 14B engaging edge 1B, and abutments between lower area of blade 14 and forward side of sleeve 12. In order to increase the draught and improve the efficiency of the hand stroke, blade 14 is bilaterally curved inward toward the rowing direction Y, as shown in FIGS. 4 and 5 in which P is designated for the palm; R is designated for the forearm.

Figure 6:
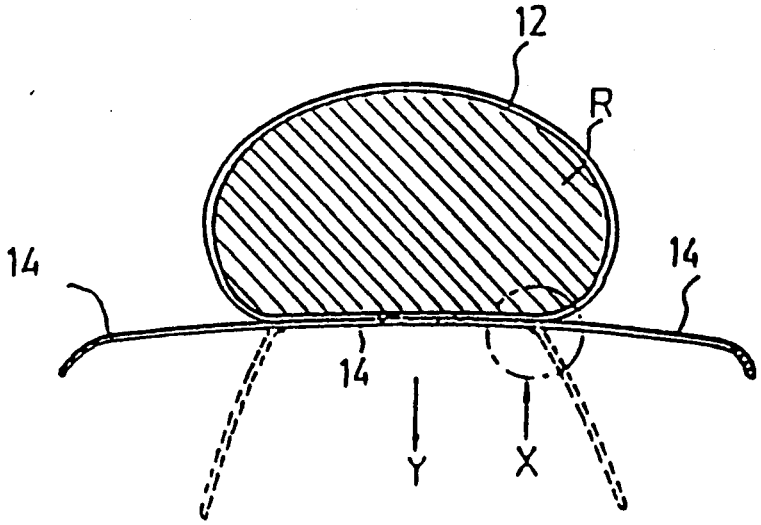
FIG. 6 is a sectional view of an alternate form of the blade taken in direction equivalent to line V—V of FIG. 2.
Figure 6A:
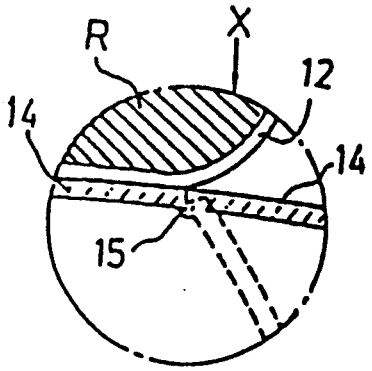
FIG. 6A is an enlarged view taken on part X of FIG. 6.

Referring to FIG. 6, in order to reduce the resistance which occurs upon each return stroke of the hand, two elongated connecting lines 15 are made on blade 14 adjacent to sleeve 12 (namely, the forearm R) on two opposite locations longitudinally. Connecting lines 15 respectively provide blade 14 with the function of a hinge so that the two opposite parts 14A of the blade 14 are respectively turned inward toward the rowing direction Y (see the dotted lines in FIG. 6) upon each return stroke of the hand. Connecting lines 15 are formed by making cuts on blade 14 on the back side (opposite to the rowing direction Y) at a proper depth, and therefore blade 14 greatly increases the force of the forward stroke of the hand and reduces the resistance against the return stroke of the hand.

Figure 7:
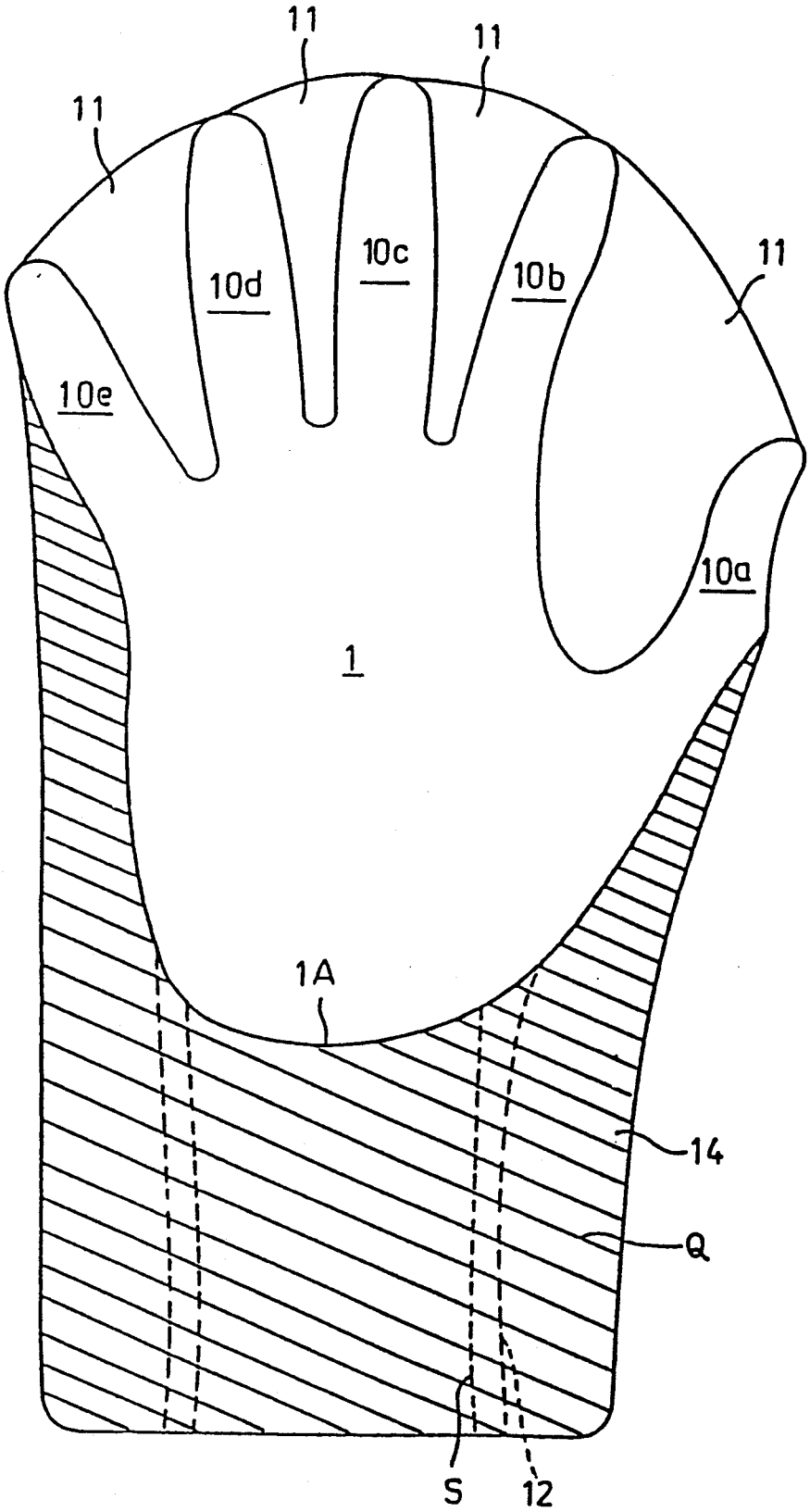
FIG. 7 is a pictorial drawing showing that embossed stripes are formed over the outside surface of the blade.

As indicated, the present invention is to provide a swimming glove made of a flexible material for maximum finger dexterity and comfort, having a blade for increasing the stroke of the hand. It is to be understood, however, that the invention is not limited to the specific features shown and various modifications could be made to the present invention without departing from the basic teachings thereof. For example, embossed stripes Q may be made on the inside surface (the palm) of the blade 14 (see FIG. 7) to reduce water resistance and the connecting lines 15 may be formed by grooves on the blade 14.

What is claimed is:

1. A swimming glove, comprising:

a glove body to fit a hand of a wearer of said swimming glove;

five finger sheaths extending from one end of said glove body;

webs joining adjacent ones of said five finger sheaths;

a sleeve extending from an opposite end of said glove body, said sleeve having a length corresponding to a front half part of a forearm of said wearer to fit said front half part of the forearm;

said glove body, said five finger sheaths, said webs, and said sleeve being made with a woven fabric into one unit;

a blade extending bilaterally outward from said sleeve, said glove body, a first finger sheath and a fifth finger sheath, said blade being curved inward toward a rowing direction and having a first area fixedly joined to said first finger sheath, said fifth finger sheath and said glove body; said blade further having a second area fixedly joined to a forward side of said sleeve, said first area of said blade having a thickness smaller than said second area of said blade, said blade being made of a flexible material having a stiffness greater than said woven fabric;

said blade have two longitudinal connecting lines along said sleeve, to enable outer parts of said second area of said blade to turn toward the rowing direction of the hand upon each return stroke, said connecting lines being formed by making cuts at a proper depth on a back side of said blade opposite to the rowing direction of the hand.

* * * * *